US006893300B2

(12) United States Patent
Zhou et al.

(10) Patent No.: US 6,893,300 B2
(45) Date of Patent: May 17, 2005

(54) CONNECTOR ASSEMBLY FOR ELECTRICAL INTERCONNECTION

(75) Inventors: Hong Zhou, Farmington Hills, MI (US); Cuong Van Pham, San Diego, CA (US)

(73) Assignee: Visteon Global Technologies, Inc., Dearborn, MI (US)

( * ) Notice: Subject to any disclaimer, the term of this patent is extended or adjusted under 35 U.S.C. 154(b) by 173 days.

(21) Appl. No.: 10/195,203

(22) Filed: Jul. 15, 2002

(65) Prior Publication Data

US 2004/0009712 A1 Jan. 15, 2004

(51) Int. Cl.[7] ..... H01R 4/48
(52) U.S. Cl. ..... 439/862
(58) Field of Search ..... 439/862, 680, 439/74, 682, 52, 63, 561, 578, 701, 78

(56) References Cited

U.S. PATENT DOCUMENTS

| | | | | |
|---|---|---|---|---|
| 706,927 A | | 8/1902 | Goodrich | |
| 3,196,378 A | * | 7/1965 | Beckwith | 439/701 |
| 3,423,716 A | | 1/1969 | Deakin | |
| 3,568,001 A | | 3/1971 | Straus | |
| 3,910,665 A | * | 10/1975 | Stull | 439/63 |
| 4,384,757 A | | 5/1983 | Andrews, Jr. et al. | |
| 4,482,937 A | | 11/1984 | Berg | |
| 4,923,405 A | * | 5/1990 | Munsterman et al. | 439/78 |
| 5,299,939 A | | 4/1994 | Walker et al. | |
| 5,376,009 A | | 12/1994 | Olsson et al. | |
| 5,624,269 A | | 4/1997 | Kanamori | |
| 5,711,676 A | * | 1/1998 | Michael, III | 439/63 |
| 5,882,210 A | * | 3/1999 | Embo et al. | 439/63 |
| 6,547,593 B1 | * | 4/2003 | Beckous | 439/581 |

FOREIGN PATENT DOCUMENTS

| | | |
|---|---|---|
| EP | 1 083 638 A1 | 3/2001 |
| WO | WO 00/79590 A1 | 12/2000 |

* cited by examiner

*Primary Examiner*—J. F. Duverne
(74) *Attorney, Agent, or Firm*—Brinks Hofer Gilson & Lione

(57) ABSTRACT

The present invention involves a universal connector assembly for electronic interconnection. The connector assembly includes a printed circuit board to which a male insert is in electrical communication. The male insert includes a strain relief tail connected to the printed circuit board and extends to a contact head. The assembly further includes a female socket for receiving the contact head of the male insert. The female socket has receiving members extending from a base to respective ends. The ends are biasingly spaced apart to define an opening through which the male insert is disposed for electrical contact with the female socket. The receiving members have an inside contact surface and an outside surface wherein the inside surface is configured to complement the outer contact wall of the male insert for electrical engagement when the male insert is disposed through the opening. The assembly further comprises a connector housing to which the base of the female socket is attached.

36 Claims, 3 Drawing Sheets

CONNECTOR ASSEMBLY FOR ELECTRICAL INTERCONNECTION

BACKGROUND OF THE INVENTION

The present invention relates to connector assemblies for electrical interconnection.

Electrical connectors and joints are known and are widely used in several different industries for various purposes. For example, in the automotive industry, electrical connectors may be used within instrument panels of a vehicle interior panel. Electrical connectors and joints allow electrical communication between systems such as a power source and a time display. Although current electrical connectors and connector assemblies are adequate, such connectors and assemblies may be improved in different ways.

For example, manufacturers of electrical connectors have been challenged in producing electrical connectors and joints which have lower electrical resistance and higher retention force. Some electrical connectors have a substantial amount of continuity resistance which lead to electrical disengagement. In some situations, electrical disengagement of connecting members may be due to high stress or pressure on the connector. Manufacturers have also been challenged in designing electrical connectors which are able to absorb pressure or distribute force placed thereon.

SUMMARY OF THE INVENTION

It is one aspect of the present invention to provide an improved connector assembly for electronic interconnection. The connector assembly includes an increased contact surface area between connecting members. As a result, stress on the connecting members and on the connector assembly is lessened, since force or resistance is distributed to a proportionally larger surface area. The connector assembly of the present invention includes and a printed circuit board (PCB) to which a male insert connects. The male insert has a strain relief tail connected to the printed circuit board and extends to a contact head. The strain relief tail is configured to be compressed during operation of the connector assembly to relieve stress or strain from the male insert and, in turn, the connector assembly. The contact head is cylindrically shaped, in one embodiment, and provides an increased amount of surface area per contact force to allow contact force to be distributed more uniformly.

The connector assembly further includes a female socket having receiving members biasingly spaced apart from each other to define an opening through which the male insert is disposed. When the male insert is disposed within the receiving members, the female socket is radially engaged with the contact head of the male insert. This allows the contact force to be distributed more uniformly about the contact head and provides an improved retention force which lessens a likelihood of disengagement resistance. The connector assembly further includes a connector housing to which the female socket is mounted. The connector assembly further has a connecting member which is configured to cooperate with the connector housing to secure the male insert with the female socket, defining a locking mechanism. This locking mechanism further provides an increased retention force between the male insert and the female socket.

These and other advantages, features and benefits of the invention will become apparent from the drawings, detailed description and claims which follow.

DETAILED DESCRIPTION OF THE INVENTION

Figure 1:
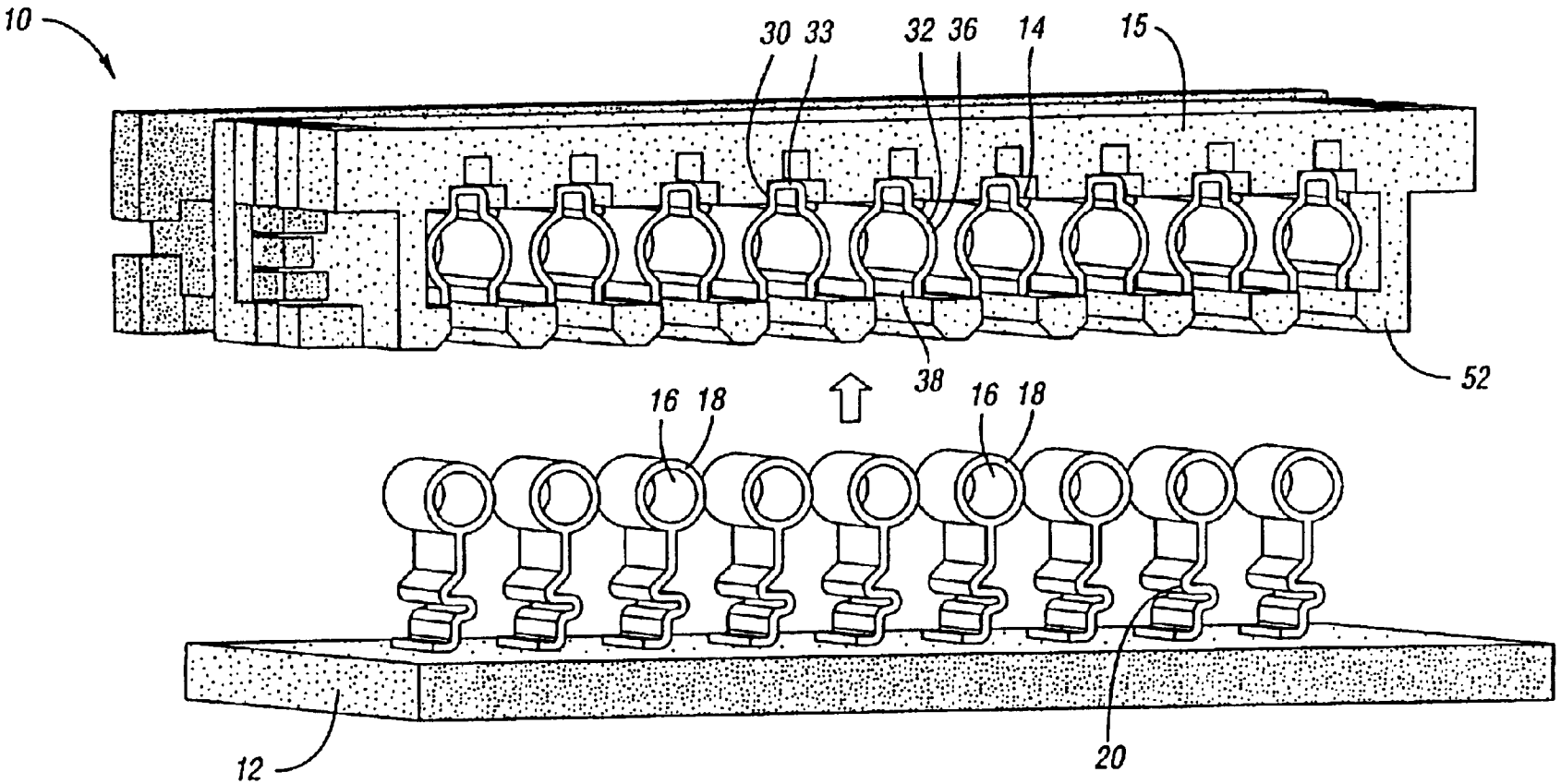
FIG. 1 is a perspective view of one embodiment of a universal connector assembly in a disengaged position in accordance with the present invention.

FIG. 1 illustrates one embodiment of a universal connector assembly 10 in a disengaged position for electronic interconnection. Electronic interconnection may be used in various suitable industries, especially the automotive industry. For example, the universal connector assembly 10 may be used for electrical communication between electronic systems within an instrument panel of a vehicle. This may be for a light, a time display, or an indicator as applicable.

Universal connector assembly 10 includes a printed circuit board (PCB) 12 and a connector housing 15 cooperating with a connecting member 14. Printed circuit board 12 may be any suitable circuit board used in the electronic arts. In this embodiment, connecting member 14 has one or a plurality of fingers extending therefrom to cooperate with connector housing 15 to secure electrical contacts of connector assembly 10 as described in greater detail below.

Figure 2:
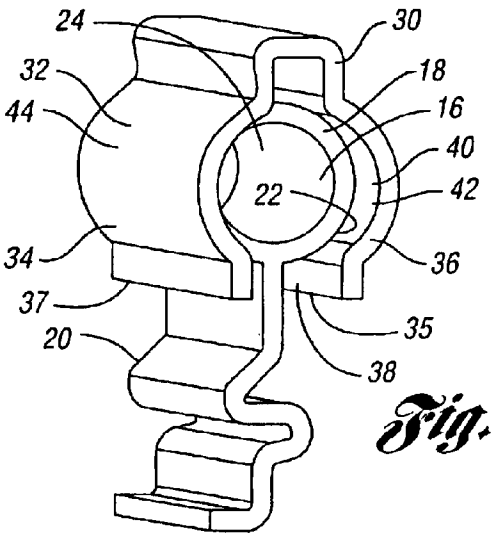
FIG. 2 is a perspective view of a male insert and a female socket of the universal connector assembly in an engaged position in accordance with the present invention.

As shown in FIG. 2, connector assembly 10 further includes a male insert 16 having a contact head 18 and a strain relief tail 20 extending therefrom. Contact head 18 includes an outer contact wall 22 and an inner wall 24. In this embodiment, contact head 18 is cylindrically shaped. As shown, strain relief tail 20 is attached to and is in electrical communication with printed circuit board 12. Strain relief tail 20 extends from contact head 18 to attach to printed circuit board 12. In use, strain relief tail 20 arcuately extends to contact head 18 to relieve strain on the male insert 16 and may serve as a spring for absorbing stress on the male insert. As shown, strain relief tail 20 is configured to compress for relieving stress on the male insert 16 when pressure is placed thereon.

In this embodiment, strain relief tail 20 serpentinely extends from printed circuit board 12 to contact head 18. However, strain relief tail 20 may be formed in any shape or configuration so long as it is configured to compress for relieving stress or strain on the male insert during operation of the connector assembly.

Figure 3:
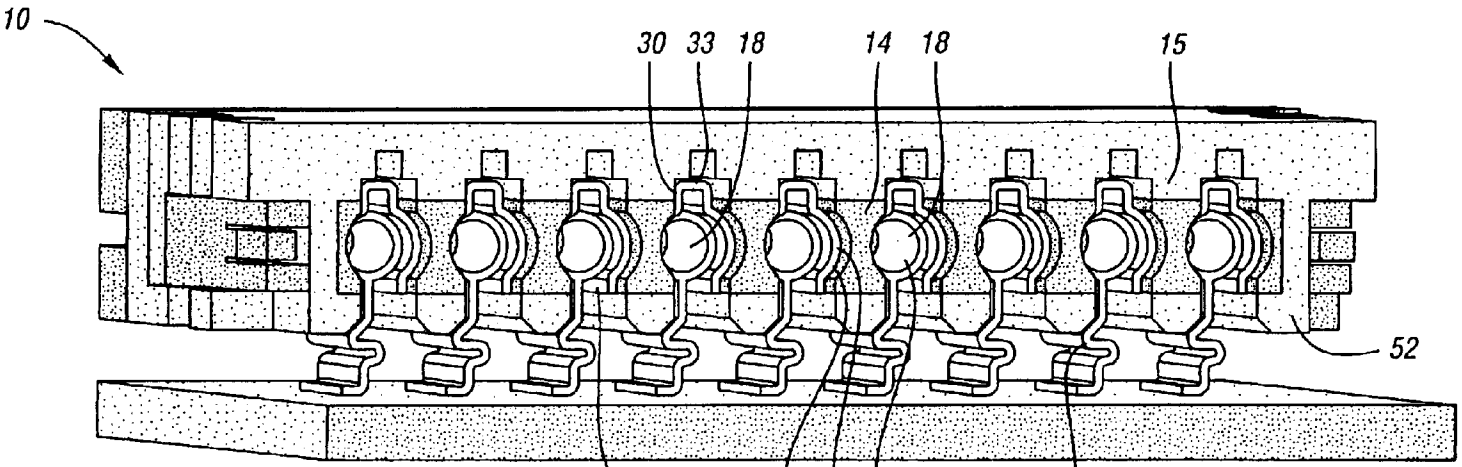
FIG. 3 is another perspective view of the universal connector assembly in an engaged position.

As shown in FIGS. 2 and 3, universal connector assembly 10 further includes a female socket 30 for receiving the male insert 16. In this embodiment, universal connector assembly 10 includes a plurality of female sockets 30. Each of the female sockets 30 includes a pair of receiving members 32. Each pair of the receiving members 32 includes a first arcuate member 34 and a second arcuate member 36 connected to each other at a base 33. Each of the arcuate members 34, 36 has ends 35, 37, respectively. As shown in FIG. 3, arcuate members 34, 36 are biasingly spaced apart at the ends 35, 37 to define an opening 38 through which male insert 16 is disposed for electrical contact with the female socket in an engaged position.

As shown, first and second arcuate members 34, 36 have an inside contact surface 42 and an outside surface 44. Inside contact surface 42 is configured to complement and cooperate with the outer contact wall 22 of male insert 16 for electrical engagement when male insert 16 is disposed through the opening 38. As the first and second arcuate members are in biased relationship with each other, a space therebetween defines inner space 40 in which contact head 18 is disposed in the engaged position.

In this embodiment, first and second arcuate members 34, 36 complement the cylindrical shape of the contact head to receive the male insert 16 for engagement therein. Of course, as the shape of the contact head varies, configuration of the inside contact surface may change to complement and cooperate with the contact head.

As shown in FIGS. 2 and 3, receiving member 32 of female socket 30 radially engages contact head 18 of male insert 16 when the contact head is disposed in space 40. This provides greater retention force of the male insert within the female socket and provides an improved distribution of electrical continuity between the male insert and the female socket when engaged. The distribution of electrical continuity is improved due to increased surface area contact per contact force. It has been found that the greater the contact surface area per contact force, the less stress is experienced by the assembly at the electrical connection. Radial engagement of the receiving member on the contact head provides an increased surface area contact which results in reduced stress and strain placed on the male insert and female socket.

In this embodiment, retention force is a force of the female socket and the connecting member to retain the male insert in the female socket. Contact force is a force at a point of contact between the male insert and female socket.

The male insert 16 is disposed through opening 38 of female socket 30. Thus, although arcuate members 34, 36 are biased together to define opening 38, arcuate members 34, 36 are configured to be flexible for male insert 16 to fit through opening 38. Arcuate members 34, 36 are configured to be biasingly spaced apart from each other so that when male insert 16 is disposed therethrough, the inside contact surface 42 of members 34, 36 radially engages outer contact wall 22 of contact head 18 at a predetermined retention force which is substantially uniformly distributed about contact head 18. The predetermined retention force may be any suitable force which maintains engagement of the contacts and allows the arcuate members to flex to receive the male insert.

In another embodiment, the receiving members of the female socket may be configured to be flexible for the male insert to fit through the opening with substantially zero insertion force.

It is to be understood that the universal connector assembly in accordance with the present invention may include a single male insert and a single female socket or may include a plurality of male inserts and female sockets as applicable without falling beyond the scope or spirit of the present invention. In this embodiment, the universal connector assembly includes a plurality of male inserts and female sockets. Preferably, but not necessarily, the universal connector assembly includes the same number of male inserts as the number of female sockets. However, for simplistic purposes, only one male insert and one female socket may be described herein.

As mentioned, universal connector assembly 10 includes connector housing 15 to which the base 33 of the female sockets 30 are mounted. Connector housing 15 is configured to cooperate with the connecting member 14 to secure male insert 16 with female socket 30.

Figure 4:
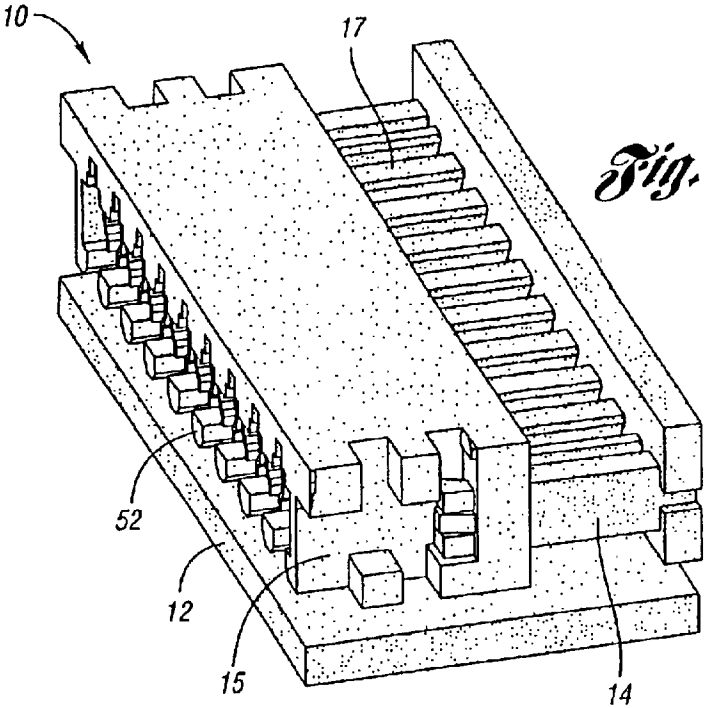
FIG. 4 is a perspective view of a locking mechanism implemented by the universal connector assembly.
Figure 5:
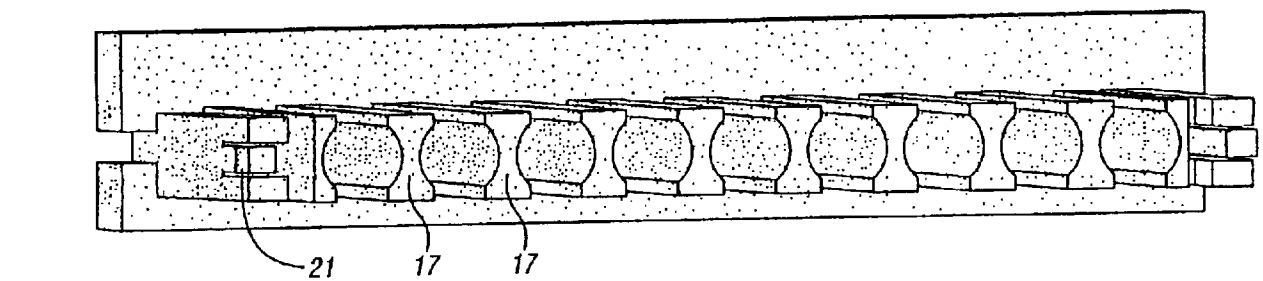
FIG. 5 is a perspective view of a connecting member of the locking mechanism for added retention force in accordance with the present invention.

As shown in FIGS. 3 and 4, connector housing 15 includes a plurality of separation members 52, each of which is configured to separate and insulate a connected pair of female sockets of the connector assembly. This may be accomplished by having a plurality of separation members extending between each female socket, thereby insulating each female socket from the other. Of course, other configurations do not fall beyond the scope or spirit of the present invention.

In this embodiment, connecting member 14 is configured to fit within connector housing 15 between each of the plurality of female sockets 30. Connecting member 14 has snap-on members 21 which snap or secure the connecting member within connector housing 15. Fingers 17 of connecting member 14 are each disposed between the female sockets 30 and take on a shape which complements the outside surface 44 of the female sockets 30. In operation, this retains the male insert within the corresponding female socket and, as a result, allows further retainment of the contacts. The connecting member and the housing member define a locking mechanism of the universal connector assembly which provides added retention force between the male insert and the female socket. The locking mechanism reduces a likelihood of disengagement between the male insert and female socket by locking the arcuate members and securing the male insert therebetween.

The male insert and the female socket may be made of any suitable material such as copper, bronze, or brass. Moreover, the male insert or female socket may be coated with aluminum alloy, tin, nickel, silver, or zinc alloy, or any suitable conductive coating known in the art.

The present invention may be used in numerous electrical and mechanical interconnections. Such interconnections may include lap joining, but joining, large tolerance bus joining, insert module assembly, or surface mounted module assembly. In use, electrical connections implemented may include board-to-board, board-to-wire, service mount technology, or other suitable connections. Moreover, it is to be understood that the connector housing should be made of an insulating material such as plastic or plastic with reinforced fiberglass.

In use, when the male insert is inserted within the female socket, the retention force or the force used to retain the male insert in the female socket is distributed about a contact surface area of the contact head. The present invention reduces stress or strain at an electrical connection between the male insert and the female socket. As a result, stress is reduced on the assembly which decreases a likelihood of electrical communication problems.

As it can be seen, the strain relief tail is configured in a serpentine or arcuate shape. In use, this allows the universal connector assembly to be compressed and absorb stress thereon without electrical failure. As shown, the serpentine shape of the stress relief tail allows the tail to flex or bend to absorb external forces and strains. The strain relief tail serves as a spring or an absorber to receive and to absorb external forces on the universal connector assembly. It has been determined that this function of the strain relief tail lessens electrical failure of the universal connector assembly and reduces disengagement of the male insert and the female socket.

In this embodiment, the universal connector assembly is shown to have a particular shape and structure. However, other shapes and structures may be used to define the universal connector assembly without falling beyond the scope or spirit of the present invention.

Figure 6:
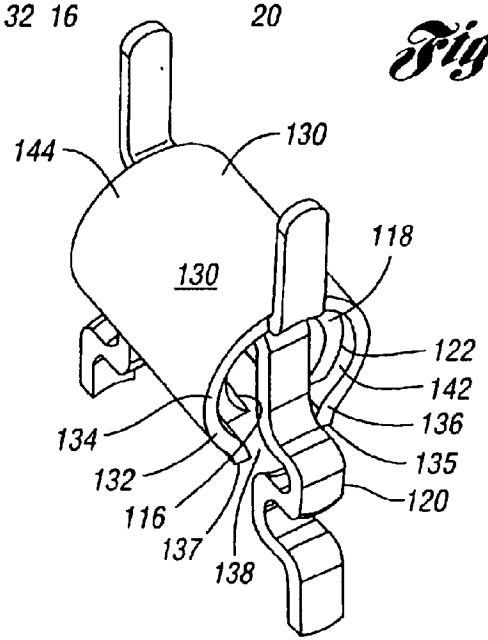
FIG. 6 is a perspective view of another embodiment of the male insert and the female socket of the universal connector assembly.

FIG. 6 illustrates another embodiment of a male insert and a female socket in accordance with the present invention. In this embodiment, a male insert 116 has a contact head 118 which is configured to be received by the female socket (discussed below). The male insert and the female socket of this embodiment are configured to be attachable to the printed circuit board and the housing assembly, respectively, as described in the embodiment above.

As shown, the contact head 118 includes a cylindrical outer contact wall 122 formed by a pair of integral members extending from an apex of the contact head and biasingly spaced apart from each other. The contact head 118 further has two ends. At each of the ends, a strain relief tail 120 serpentinely extends from the apex of the contact head. Strain relief tail 120 is configured to attach to and be in electrical communication with the printed circuit board discussed above. In use, strain relief tail 120 arcuately extends to contact head 118 to relieve strain from the male insert 116 and may serve as a spring for absorbing stress on the male insert. Strain relief tail 120 is configured to compress for relieving stress on the male insert 116 when pressure is placed thereon.

As shown, a female socket 130 receives the male insert 116. In this embodiment, the female socket 130 includes a pair of receiving members 132. The receiving members 132 includes a first arcuate member 134 and a second arcuate member 136 integrally connected to each other. The arcuate members 134, 136 has ends 135, 137, respectively. As shown, arcuate members 134, 136 are biasingly spaced apart at the ends 135, 137 to define an opening 138 through which male insert 116 is disposed for electrical contact with the female socket in an engaged position. During insertion of male insert 116 into female socket 130, the pair of integral members may be flexed together to be receive by the female socket 130.

As in the embodiment above, this embodiment includes first and second arcuate members 134, 136 having an inside contact surface 142 and an outside surface 144. Inside contact surface 142 is configured to complement and cooperate with the outer contact wall 122 of male insert 116 for electrical engagement when male insert 116 is disposed through the opening 138.

While the invention has been described in terms of preferred embodiments, it will be understood, of course, that the invention is not limited thereto since modifications may be made by those skilled in the art, particularly in light of the foregoing teachings.

What is claimed is:

1. A connector assembly for electrical interconnection, the assembly comprising:

a printed circuit board;

a male insert having a contact head and a strain relief tail, the strain relief tail being attached to the printed circuit board and arcuately extending to the head for strain relief on the male insert, the head having an outer contact wall and an inner wall;

a female socket for receiving the male insert, the female socket having receiving members, the receiving members extending from a base of the female socket to corresponding ends being biasingly spaced apart to define an opening through which the male insert is disposed for electrical contact with the female socket, the receiving members having an inside contact surface and an outside surface, the inside contact surface being configured to complement the outer contact wall of the male insert for electrical engagement when the male insert is disposed through the opening; and a connector housing to which the base of the female socket is attached.

2. The connector assembly of claim 1 wherein the strain relief tail is electrically attached to the printed circuit board.

3. The connector assembly of claim 1 wherein the strain relief tail non-linearly extends to the head to relieve strain on the male insert.

4. The connector assembly of claim 1 wherein the strain relief tail is a spring electrically attached to the printed circuit board for absorbing stress on the male insert.

5. The connector assembly of claim 1 wherein the contact head of the male insert is cylindrically shaped.

6. The connector assembly of claim 1 wherein the receiving members of the female socket are first and second arcuate members biasingly connected to each other and define an inner space complementing the cylindrically shaped head to receive the male insert for engagement therein.

7. The connector assembly of claim 6 wherein the first and second arcuate members radially engage the outer contact wall of the head of the male insert.

8. The connector assembly of claim 1 wherein the strain relief tail is configured to compress for relieving stress on the male insert.

9. The connector assembly of claim 1 wherein the male insert is a plurality of male inserts and the female socket is a plurality of female sockets, wherein each female socket complements one female insert.

10. The connector assembly of claim 9 wherein the connector housing to which each of the female sockets is mounted includes separation members extending from the connector housing and between each of the female sockets for separation of the female sockets from each other.

11. The connector assembly of claim 10 further comprising a connecting member for securing each of the male inserts with one of the female sockets, the connecting member having a plurality of fingers, each of the fingers being disposed between the female sockets, each of the fingers complementing the female socket to cooperate and engage therewith when the male insert is disposed within the receiving members.

12. The connector assembly of claim 1 wherein the male insert is made of conductive material.

13. The connector assembly of claim 12 wherein the conductive material includes copper, bronze, brass, and zinc alloy.

14. The connector assembly of claim 12 wherein the male insert includes a coating, wherein the coating includes aluminum alloy, tin, nickel, and silver.

15. The connector assembly of claim 1 wherein the female socket is made of a conductive material.

16. The connector assembly of claim 15 wherein the conductive material includes copper, bronze, brass, and zinc alloy.

17. The connector assembly of claim 15 wherein the female socket has a coating, the coating including aluminum alloy, tin, nickel, and silver.

18. A universal connector assembly for electrical interconnection, the assembly comprising:

a printed circuit board;

a male insert having a contact head and a strain relief tail, the strain relief tail being attached to the printed circuit board and arcuately extending to the head for strain relief on the male insert, the head having an outer contact wall and an inner wall;

a female socket for receiving the male insert, the female socket having first and second arcuate members attached at a base and extending to first and second ends, respectively, the first and second ends being biasingly spaced apart to define an opening through which the male insert is disposed for electrical contact with the female socket, the first and second arcuate members having an inside contact surface and an outside surface, the inside contact surface being configured to complement the outer contact wall of the male insert for electrical engagement when the male insert is disposed through the opening; and a connector housing to which the base of the female socket is attached.

19. The connector assembly of claim 18 wherein the strain relief tail is electrically attached to the printed circuit board.

20. The connector assembly of claim 18 wherein the strain relief tail non-linearly extends to the head to relieve strain on the male insert.

21. The connector assembly of claim 18 wherein the strain relief tail is a spring electrically attached to the printed circuit board for absorbing stress on the male insert.

22. The connector assembly of claim 18 wherein the contact head of the male insert is cylindrically shaped.

23. The connector assembly of claim 18 wherein the first and second arcuate members are biasingly connected to each other and define an inner space complementing the cylindrically shaped head to receive the male insert for engagement therein.

24. The connector assembly of claim 23 wherein the first and second arcuate members radially engage the outer contact wall of the head of the male insert.

25. The connector assembly of claim 18 wherein the strain relief tail is configured to compress for relieving stress on the male insert.

26. The connector assembly of claim 18 wherein the male insert is a plurality of male inserts and the female socket is a plurality of female sockets, wherein each female socket complements one female insert.

27. The connector assembly of claim 26 wherein the connector housing to which each of the female sockets is mounted includes separation members extending from the connector housing and between each of the female sockets for separation of the female sockets from each other.

28. The connector assembly of claim 18 wherein the male insert is made of conductive material.

29. The connector assembly of claim 28 wherein the conductive material includes copper, bronze, brass, and zinc alloy.

30. The connector assembly of claim 28 wherein the male insert includes a coating, wherein the coating includes aluminum alloy, tin, nickel, and silver.

31. The connector assembly of claim 18 wherein the female socket is made of a conductive material.

32. The connector assembly of claim 31 wherein the conductive material includes copper, bronze, brass, and zinc alloy.

33. The connector assembly of claim 31 wherein the female socket has a coating, the coating including aluminum alloy, tin, nickel, and silver.

34. A universal connector assembly for electrical interconnection, the assembly comprising:

a printed circuit board;

a plurality of male inserts, each male insert having a contact head and a strain relief tail, the strain relief tail being attached to the printed circuit board and arcuately extending to the head for strain relief on the male insert, the head having an outer contact wall and an inner wall;

a plurality of female sockets for receiving a male insert, each of the female sockets having first and second arcuate members attached at a base and extending to first and second ends, respectively, the first and second ends being biasingly spaced apart to define an opening through which the male insert is disposed for electrical contact with the female socket, the first and second arcuate members having an inside contact surface and an outside surface, the inside contact surface being configured to complement the outer contact wall of the male insert for electrical engagement when the male insert is disposed through the opening;

a connector housing to which each base of each of the female sockets is attached, the connector housing having separation members extending from the connector housing and disposed between the female sockets for separation of the female sockets from each other; and a connecting member for securing each of the mate inserts with one of the female sockets, the connecting member being disposed within the connector housing and having a plurality of fingers, each of the fingers being disposed between the female sockets, each of the fingers complementing the female socket to cooperate and engage therewith when the mate insert is disposed within the receiving members.

35. A connector assembly for electrical interconnection, the assembly comprising:

a printed circuit board;

a male insert including a contact head and strain relief tails, the contact head having a cylindrical outer contact wall, the contact wall being formed by a pair of integral members extending from an apex of the contact head to male inner sides, the male ends being biasing spaced apart from each other, the contact head having two head ends, each of the heed ends having a strain relief tail extending from the apex, the strain relief tail being attached to the printed circuit board, the head having an outer contact wall and an inner wall;

a female socket for receiving the male insert, the female socket having receiving members, the receiving members integrally extending from each other to corresponding ends being biasingly spaced apart to define an opening through which the male insert is disposed for electrical contact with the female socket, the receiving members having an inside contact surface and an outside surface, the inside contact surface being configured to complement the outer contact wall of the male insert for electrical engagement when the male insert is disposed through the opening; and a connector housing to which the base of the female socket is attached.

36. A connector assembly for electrical interconnection, the assembly comprising:

a printed circuit board;

a plurality of male inserts, at least one of the male inserts having a contact heed and a strain relief tail, the strain relief tall being attached to the printed circuit board and arcuately extending to the head for strain relief on the male insert, the contact head having an outer contact wall and an inner wall;

a plurality of female sockets for receiving the male inserts, at least one of the female sockets having receiving members, the receiving members extending from a base of the female socket to corresponding ends being biasingly spaced apart to define an opening through which the at least one male insert is disposed for electrical contact with the female socket, the receiving members having an inside contact surface and an outside surface, the inside contact surface being configured to complement the outer contact wall the at least one male insert for electrical engagement when the male inserts are disposed through the opening; and a connector housing to which the base of at least one of the female sockets is attached, the connector housing having separation members extending from the connector housing and disposed between the female sockets for separation of the female sockets from each other.

* * * * *